United States Patent [19]

Williams

[11] 4,423,897

[45] Jan. 3, 1984

[54] WINDOW VENTILATING STOP

[76] Inventor: D. Emerton Williams, 1410 Edith St., Berkeley, Calif. 94703

[21] Appl. No.: 186,896

[22] Filed: Sep. 15, 1980

Related U.S. Application Data

[63] Continuation of Ser. No. 950,080, Oct. 10, 1978, abandoned.

[51] Int. Cl.[3] ..... E05C 17/54

[52] U.S. Cl. ..... 292/288; 292/DIG. 46

[58] Field of Search ..... 292/150, 251, 288, DIG. 33, 292/DIG. 46, DIG. 47

[56] References Cited

U.S. PATENT DOCUMENTS

| | | | |
|---|---|---|---|
| 885,568 | 4/1908 | Bennerscheidt | 292/251 |
| 1,203,986 | 11/1916 | Curnow | 292/251 |
| 1,884,484 | 10/1932 | Yacomis | 292/150 |
| 2,264,962 | 12/1941 | Adams | 292/147 |
| 2,298,406 | 10/1942 | Miller | 49/450 X |
| 2,950,756 | 8/1960 | Maloney | 49/449 X |
| 4,079,479 | 3/1978 | Clement | 49/449 |

*Primary Examiner*—Richard E. Moore

*Attorney, Agent, or Firm*—Schapp and Hatch

[57] ABSTRACT

A device for selectively preventing more than a desired opening of a metal frame and sash window having at least one sash mounted for relative sliding movement in overlapping relation to another sash to open and close the window. A metal keeper is mounted in the side rail of the upper window of a double-hung sash and a bolt or pin extends removably therefrom for intercepting and halting opening of the window, thus permitting the window to be opened slightly for ventilation but not far enough to allow unlawful entrance. A spring-biased finger detent, extending into the bolt or pin receiving opening of the keeper, engages a circumferential groove on the bolt or pin for inhibiting accidental removal from the keeper. In another form of the invention, the bolt is screwed into the keeper.

3 Claims, 9 Drawing Figures

WINDOW VENTILATING STOP

This is a continuation of application Ser. No. 950,080 filed Oct. 10, 1978, abandoned.

BACKGROUND OF THE INVENTION

1. Field of the Invention.

The present invention relates to WINDOW VENTILATING STOP, and more particularly to devices for selectively limiting opening of sliding closures such as sliding doors, laterally sliding windows and double-hung vertically sliding windows.

2. Description of the Prior Art.

Locks and fasteners have been developed and used quite successfully with windows and doors having wooden frames. However, today more and more closure frames are being fabricated of metal. The metal being used, to a large extent, is aluminum since it eliminates the need for glazing and painting. For sliding doors and windows, whose movement is horizontal, numerous locks have been developed to prevent entrance by unauthorized individuals. The narrowness of the rails which can be fabricated from aluminum and the relative softness of the metal have been an obstacle in the development of such locks for double-hung sash (other than for the main lock which holds the closures in a closed or locked position).

The prior devices known to applicant are listed as follows:

| | | | |
|---|---|---|---|
| 766,357 | 08/1904 | Ives | 292/2 |
| 1,187,479 | 06/1916 | Anderson | 292/251 |
| 1,203,986 | 11/1916 | Curnow | 292/251 |
| 2,024,588 | 12/1935 | Lesser | 70/14 |
| 2,172,208 | 09/1939 | Kurtzon | 70/14 |
| 2,431,178 | 11/1947 | Keane | 292/145 |
| 2,516,630 | 07/1950 | Hufnagel | 292/163 |
| 2,611,634 | 09/1952 | Bevington | 292/1 |
| 2,612,398 | 09/1952 | Miller | 292/230 |
| 3,025,092 | 03/1962 | Weiner | 292/163 |

In general such devices not only are not structurally suitable for use with aluminum double-hung windows, but also they are generally quite conspicuous and intrude upon the clean appearance of aluminum sashes. Additionally, it is not generally possible to remove the prior devices from the window when they are not in use.

SUMMARY OF THE INVENTION

The device of the present invention provides a means for securing, in an adjusted position, any sliding closure element, but in particular double-hung aluminum sash and frame windows such as the Nuprime window manufactured by Season-All Industries of Indiana, Pa. These windows characteristically utilize sliding sashes having channel shaped side rails. Because of the relative softness of aluminum, rapid opening and closing of a window against a stop secured to such an aluminum channel side rail inevitably results in distortion of the side rail, interfering with both its weather sealing properties and its sliding properties in the window frame.

The present invention provides a reinforcing block or keeper concealed within the aluminum channel. The stop member is releasably secured to the keeper so as to spread the stresses of sudden impacts over a considerable area of the side rail, thus avoiding localized stresses and distortion of the aluminum. By concealing the keeper within the side rail, only an inconspicuous stud or pin is visible. When the stop device is not in use, the stud may be removed, leaving only an even more inconspicuous circular opening.

Because it is often desirable to open the window more fully than the described ventilating position, the stop pin of the present invention is releasably secured to the keeper by means of a spring-biased finger detent mounted in the keeper and extending into the stop pin opening for engaging a circumferential groove on the stop pin to restrict unwanted removal from the keeper.

Accordingly, it is an object of the present invention to provide a device for limiting the opening movement for slidable metal framed sashes and the like which is sturdy in construction and which reinforces the soft metal of the sash frame to which it is attached.

Another object of the present invention is to provide a device of the character described in which the visible portion is inconspicuous and may be removed entirely when not in use.

Other objects and features of the present invention will in part be obvious and will in part appear hereinafter.

Figure 1:
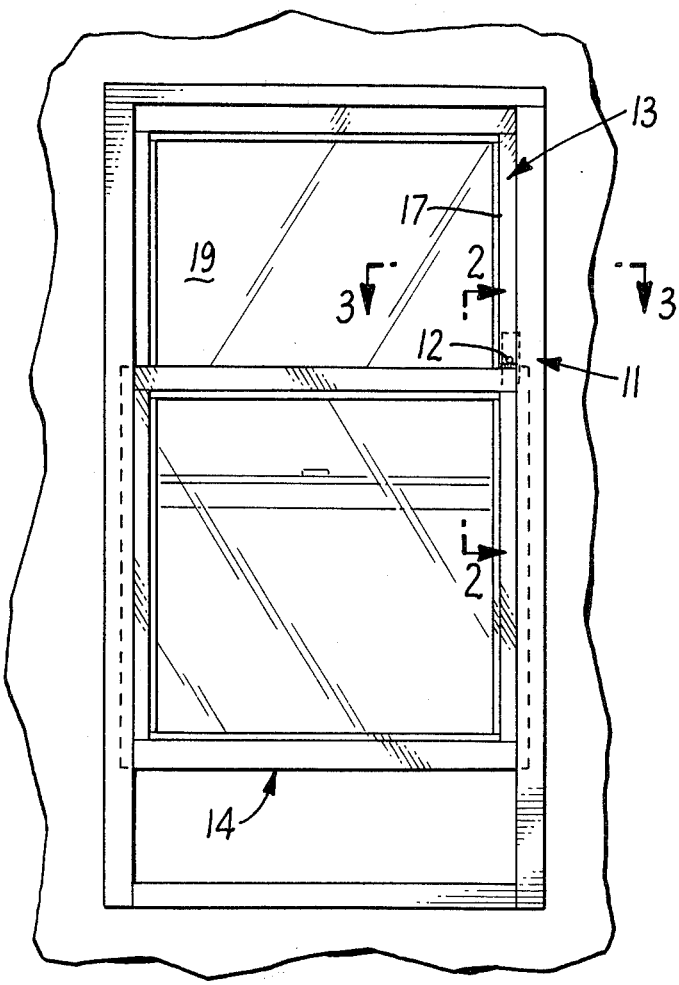
FIG. 1 is a front elevational view of a window ventilating stop constructed in accordance with the present invention, the view being taken from inside the building.

While only certain preferred forms of the invention have been illustrated in the drawings, it will be apparent that other modifications could be made within the ambit of the invention as set forth in the claims.

DESCRIPTION OF THE PREFERRED EMBODIMENTS

Figure 2:
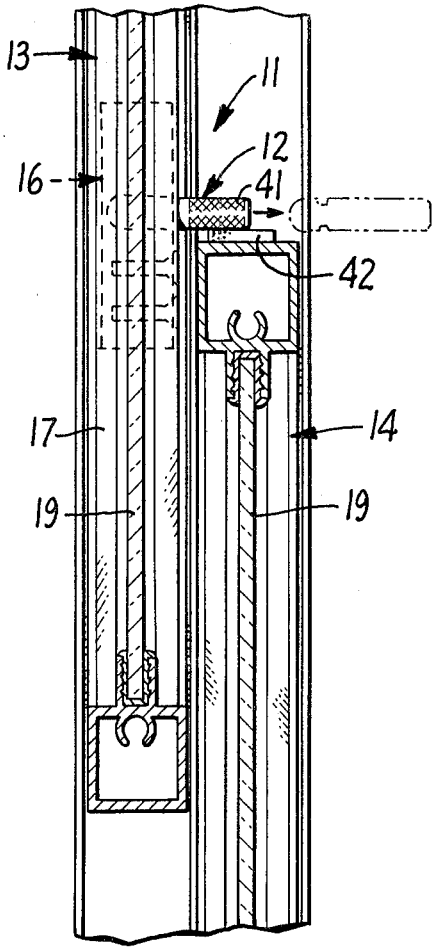
FIG. 2 is an enlarged fragmentary vertical cross-sectional view taken substantially on the plane of line 2—2 of FIG. 1.

Referring now to FIGS. 1 and 2 of the drawings, it will be seen that the window ventilating stop 11 of the present invention consists essentially of an elongated stop member 12 mountable on one sash 13 and extending therefrom into the path of relative movement of another sash 14 in position to intercept the latter and limit such relative movement to provide a desired maximum opening of the window, the stop member 12 being releasably engaged with a reinforcing keeper 16 mountable within a side rail 17 of sash 13.

In each of the embodiments shown, the general configuration of the stop remains the same with a stop bolt or pin 12 and keeper 16 employed to obstruct relative movement of the closures beyond a prescribed distance. In each instance, the keeper snugly nests within the channel shaped side rail 17 in such position that, with the pin inserted in the keeper, relative movement of the sash is limited to the distance between the top of the lower sash and the stop pin.

A preferred embodiment of the invention is illustrated in FIGS. 1, 2, 3, 4 and 6 of the drawings. As there shown, the keeper 16 is adapted for use with a sash side rail 17 having reinforcing flanges or ribs 18 running the length of the channel near the bottom of the channel. A glass pane 19 is mounted in the conventional manner in a plastic edge member 21 retained between flanges 22 extending inwardly from side rail 17. Upper sash 13 and lower sash 14 slide vertically in channels provided by the window frame 23 and are provided with vertically extending seals 24.

Figure 6:
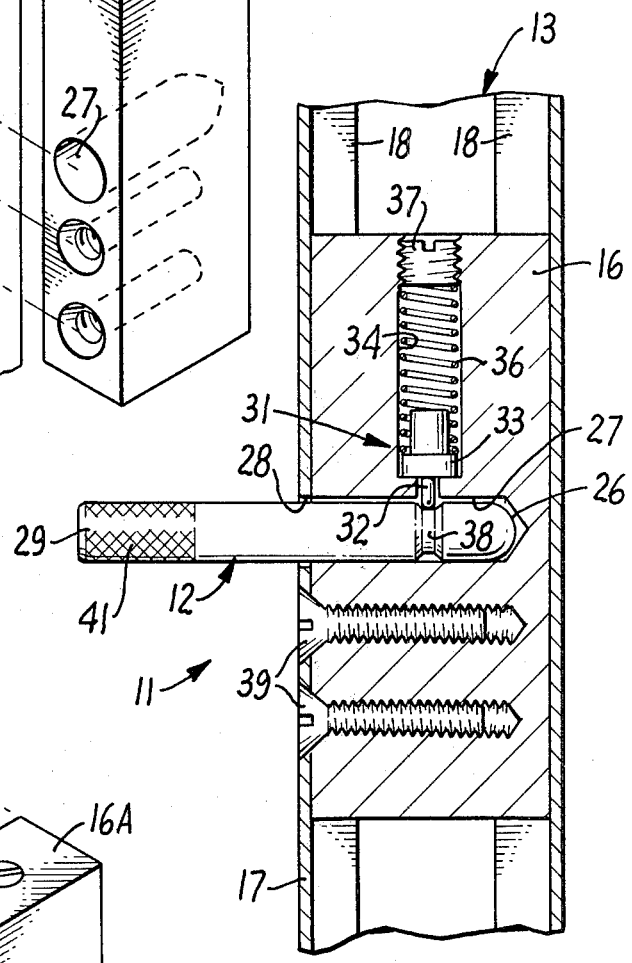
FIG. 6 is a vertical cross-sectional view through the window ventilating stop of FIG. 4, showing the parts assembled and details of the structure of a detent retaining device.

As illustrated in FIG. 6 of the drawings, the stop pin 12 is generally cylindrical, having a rounded end 26 receivable in a bore 27 aligned with a corresponding bore 28 formed in the side rail 17; the distal end 29 of pin 12 extending therefrom to intercept sash 14. Finger detent means 31 is carried by keeper 16 for releasably retaining stop pin 12 in bore 27.

As shown in FIG. 6, detent means 31 includes a finger detent member 32 having an enlarged carrier portion 33 slideably mounted in a vertically extending bore 34 opening to the top of keeper 16. A compression spring 36 is also mounted in bore 34 between the carrier portion 33 and a retainer member 37. Detent finger 32 engages in a peripheral groove 38 formed in stop pin 12 near its end 26, the finger 32 being biased into groove 38 by compression spring 36 in such manner as to permit intentional removal of pin 12 from the keeper 16 while effectively preventing unintentional removal.

The stop pin 12 may be removed from the bore 27 rapidly and easily by pulling firmly in an axial direction on the knurled end 41. The inclined sides of groove 38 force the detent finger 32 upwardly, compressing the spring 36 and allowing withdrawal of the bolt. A chain (not shown) may be fastened to the knurled end of the bolt and to the frame to avoid misplacement of the bolt when it is removed from the keeper for a wider opening of the window.

The keeper 16 may consist of a block or piece of metal, wood, plastic, or any other material strong enough to support the stop pin 12. Keeper 16 fits snugly within the channel 17 and is secured thereto against vertical movement. This may be accomplished by bonding keeper 16 to side rail 17 or, as here shown, by machine screws 39 threaded into keeper 16 through countersunk openings in side rail 17.

The distal end 29 of stop pin 12 may be knurled as indicated at 41 to facilitate removal. Also, in order to protect the upper edge of lower sash 14 against damage and distortion when it strikes pin 12, a suitable metal, wood or plastic pad 42 may be secured thereat, see FIGS. 2 and 3.

Figure 3:
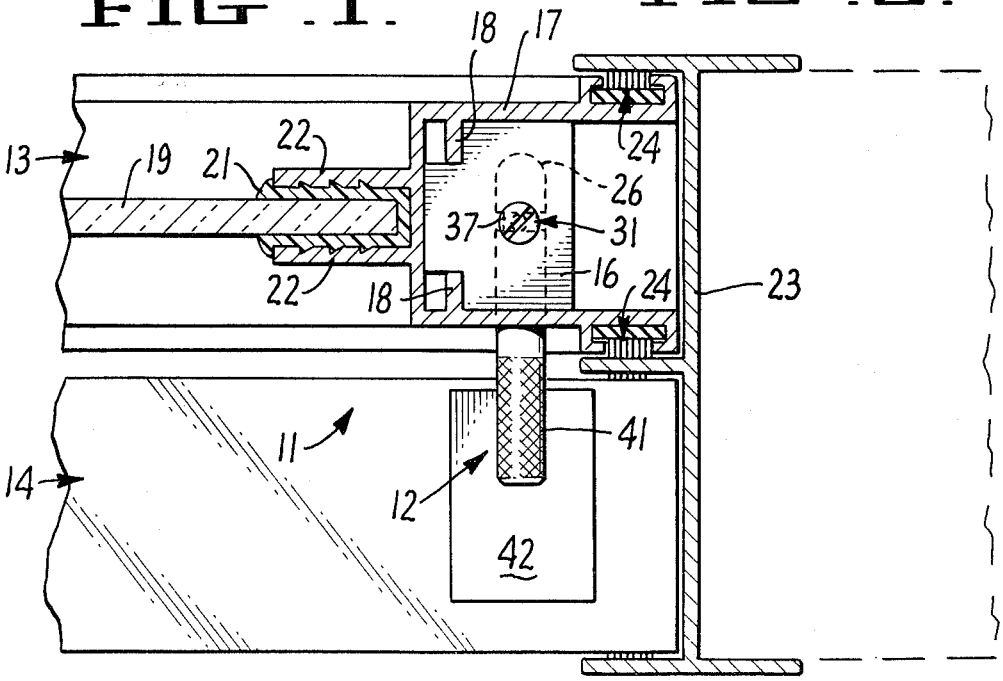
FIG. 3 is a further enlarged fragmentary plan sectional view taken substantially on the plane of line 3—3 of FIG. 1.
Figure 4:
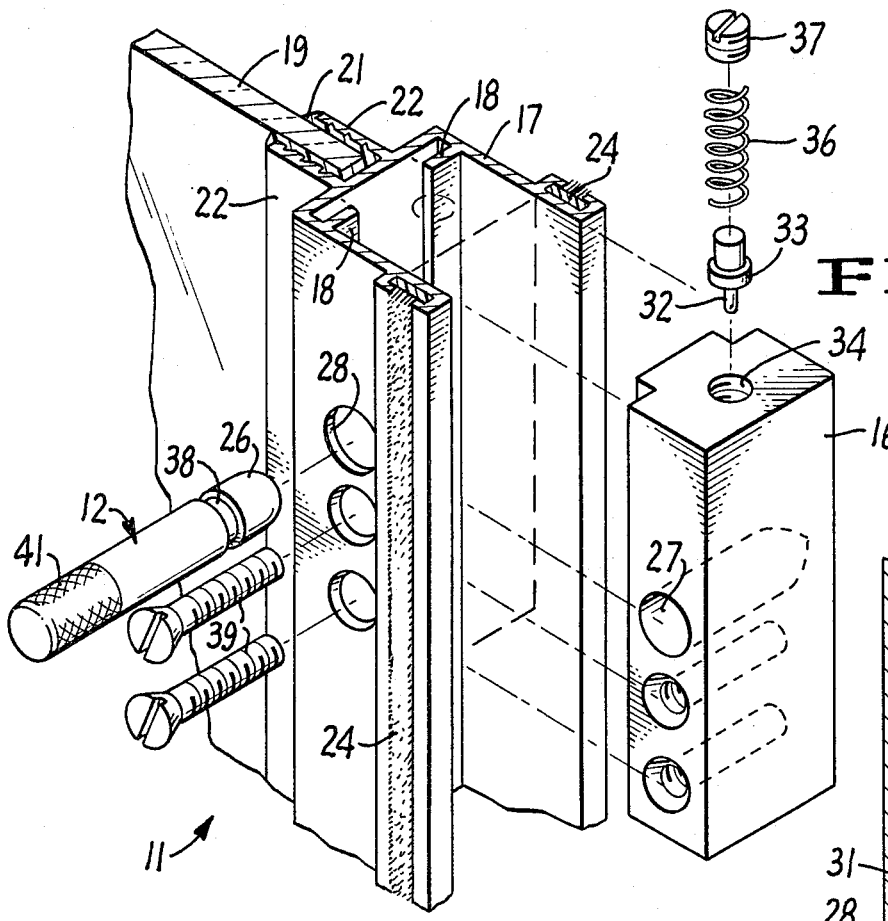
FIG. 4 is an exploded isometric view of one form of the window ventilating stop of the present invention, together with associated portions of a metal window sash vertical side rail.
Figure 5:
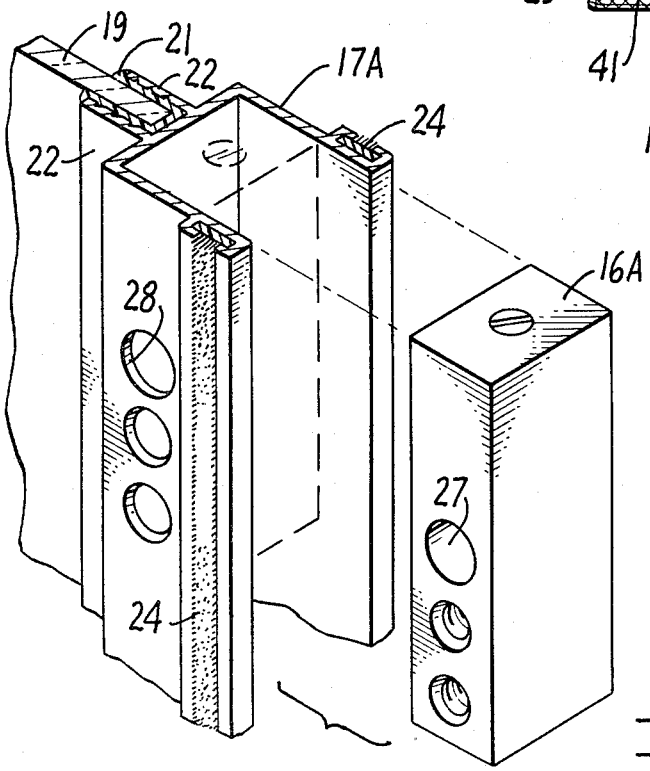
FIG. 5 is a view similar to that of FIG. 4 but with certain parts omitted and other parts assembled, this view showing a keeper similar to that of FIG. 4, but of modified form adapting the keeper to a different shape of side rail.

The form of the invention illustrated in FIG. 5 is adapted for use in connection with aluminum sash side rails 17A not having the inwardly directed, confronting flanges 18 shown in FIGS. 3 and 4 of the drawings. For this purpose, the keeper 16A is of rectangular horizontal cross-section rather than the T-shaped cross-section of the keeper 16 illustrated in FIGS. 3 and 4.

For certain installations where removal of the stop pin 12 is less frequent, considerable cost savings can be effected by eliminating the detent means 31 and screwing the pin 12 directly into the keeper 16. This form of the invention is illustrated in FIGS. 7, 8 and 9 of the drawings and, of course, is adapted to both the T-shaped and plain rectangular keeper blocks.

Figure 7:
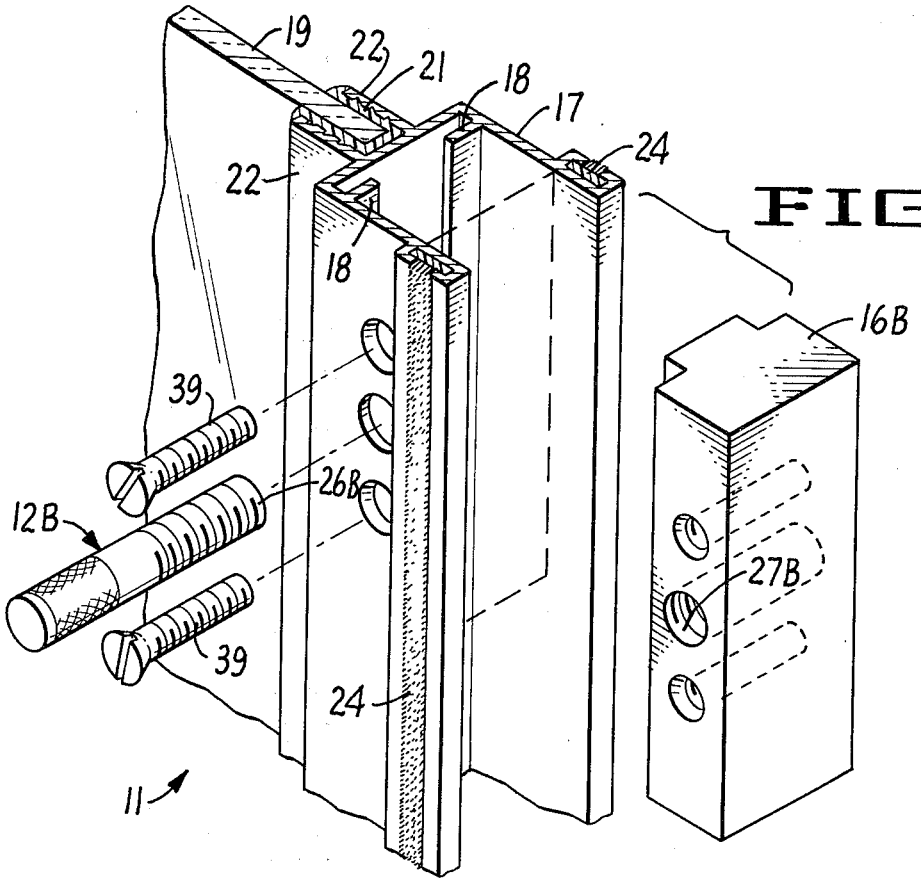
FIG. 7 is a view similar to that of FIG. 4, but showing a modified form of the invention in which the stop pin is threadably engaged in the keeper block.
Figure 8:
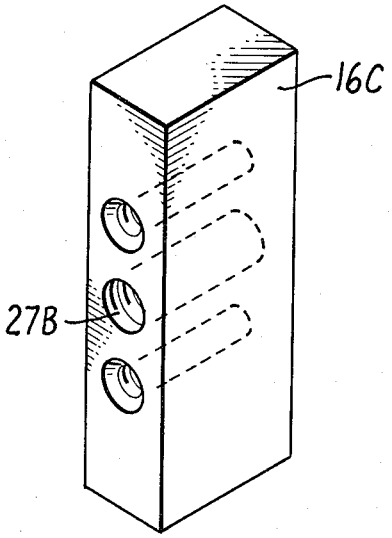
FIG. 8 is an isometric view of the modified form of keeper block shown in FIG. 5, but further modified for threaded engagement with the stop pin.
Figure 9:
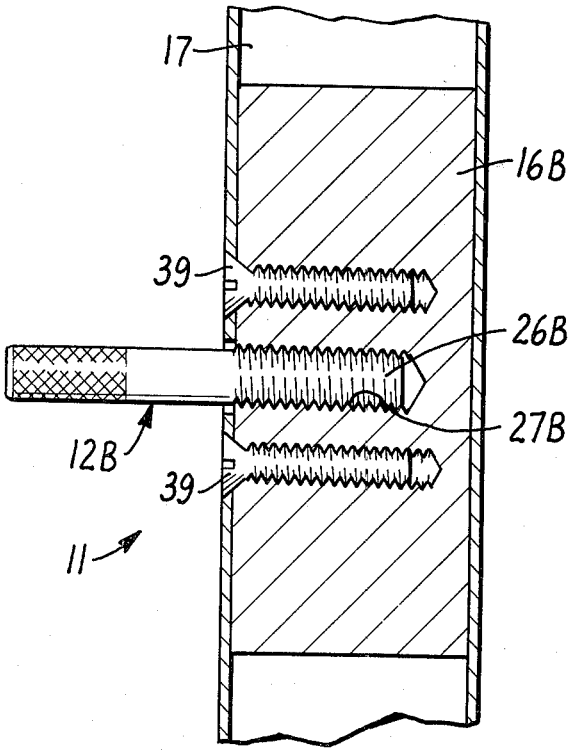
FIG. 9 is a vertical cross-sectional view through the window ventilating stop of FIG. 7, but with the parts assembled.

As shown in FIGS. 7 and 9, the inner end 26B of stop pin 12B is formed for threaded engagement in bore 27B in keeper 16B. The keeper is retained against relative movement within side rail 17 by machine screws 39.

The above described structure is particularly suited for mounting in existing windows with a minimum of difficulty. Of course, the keeper blocks 16 may also be welded or otherwise secured in place, or may be performed as a part of the side rail 17. If desired, the distal end 29 of stop pin 12 may be encased in a plastic or rubber sheath to further prevent possible damage to the top of the lower sash if the window is opened too vigorously. In such case, if desired, the pad 42 could be eliminated.

From the foregoing, it will be seen that the window ventilating stop of the present invention is particularly adapted to use in connection with aluminum frame windows, and the like, effectively reinforcing and strengthening the side rail of the sash and providing minimal interference of the opening limiting stop with the appearance of the window.

What is claimed is:

1. In a closure for a building opening having overlapping metal framed glass closure panels formed with outwardly projecting parallel spaced flanges slidable in metal channels affixed to the building, a stop device for selectively restricting how far said panels can be overlapped and hence the amount of opening while permitting such opening to the desired position, comprising an elongated keeper block mounted between said parallel spaced flanges in reinforcing contact therewith, means for securing said keeper block in place between said parallel spaced flanges, and an elongated stop member, said keeper block and the one of said flanges adjacent to the other closure panel being formed with a bore receiving said stop member with said stop member projecting therefrom in position to intercept the end of said other closure panel and halt further relative opening movement between said panels.

2. A device as described in claim 1, and wherein said stop member and said keeper are provided with spring loaded detent means for releasably securing said stop member in said bore.

3. A device as described in claim 1, and wherein said stop member is formed for threaded engagement in said bore in said keeper.

* * * * *